US010794212B2

(12) United States Patent
Kim

(10) Patent No.: US 10,794,212 B2
(45) Date of Patent: Oct. 6, 2020

(54) ROTOR HAVING IMPROVED STRUCTURE, AND TURBINE AND GAS TURBINE INCLUDING THE SAME

(71) Applicant: DOOSAN HEAVY INDUSTRIES & CONSTRUCTION CO., LTD., Changwon-si, Gyeongsangnam-do (KR)

(72) Inventor: Ki Baek Kim, Changwon-si (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 189 days.

(21) Appl. No.: 16/039,340

(22) Filed: Jul. 19, 2018

(65) Prior Publication Data

US 2019/0101015 A1 Apr. 4, 2019

(30) Foreign Application Priority Data

Sep. 29, 2017 (KR) ..... 10-2017-0127458

(51) Int. Cl.
*F01D 5/18* (2006.01)
*F01D 11/18* (2006.01)
*F01D 5/30* (2006.01)

(52) U.S. Cl.
CPC ..... *F01D 11/18* (2013.01); *F01D 5/187* (2013.01); *F01D 5/3007* (2013.01); *F05D 2240/30* (2013.01); *F05D 2240/307* (2013.01); *F05D 2250/711* (2013.01); *F05D 2260/202* (2013.01)

(58) Field of Classification Search
CPC ..... F01D 11/18; F01D 5/187; F01D 5/3007; F01D 5/20; F01D 5/141; F05D 2240/30; F05D 2240/307; F05D 2250/711; F05D 2260/202
See application file for complete search history.

(56) References Cited

U.S. PATENT DOCUMENTS 5,340,274 A * 8/1994 Cunha ..... F01D 5/182 415/115
2004/0012151 A1 1/2004 Beeck et al.
2005/0106030 A1 5/2005 Bachofner et al.
2006/0280606 A1* 12/2006 Busbey ..... F01D 5/187 416/97 R (Continued)

FOREIGN PATENT DOCUMENTS

KR 20-0174662 Y1 4/2000

*Primary Examiner* — Aaron R Eastman
(74) *Attorney, Agent, or Firm* — INVENSTONE Patent, LLC

(57) ABSTRACT

A rotor, installable in a casing of a turbine and configured to be rotated by a flow of combustion gas and cooled by a flow of compressed air, has an improved structure to keep a tip clearance constant during operation of a gas turbine. The rotor includes a disk having an outer circumferential surface; a platform installed on the outer circumferential surface of the disk; and a blade airfoil formed on an upper surface of the platform, the blade airfoil having an airfoil end situated opposite to the platform, the airfoil end having an upstream side and a downstream side with respect to a flow direction of the combustion gas, wherein the blade airfoil is formed so that, when the rotor is installed in the casing, the downstream side of the airfoil end is closer to an inner surface of the casing than the upstream side of the airfoil end.

19 Claims, 7 Drawing Sheets

(56) References Cited

U.S. PATENT DOCUMENTS

| | | | | |
|---|---|---|---|---|
| 2013/0136599 | A1* | 5/2013 | Harding | F01D 25/12 416/95 |
| 2015/0040582 | A1* | 2/2015 | Dong | F01D 5/187 60/806 |
| 2015/0118059 | A1* | 4/2015 | Perrot | F01D 5/14 416/238 |
| 2015/0204194 | A1* | 7/2015 | Tapia | F01D 5/04 416/219 R |
| 2015/0240651 | A1* | 8/2015 | Tham | F01D 11/122 415/1 |
| 2016/0003048 | A1* | 1/2016 | Gray | F01D 5/141 60/805 |
| 2016/0084090 | A1* | 3/2016 | Suciu | F01D 5/18 416/1 |
| 2016/0084091 | A1* | 3/2016 | Papple | F01D 5/186 416/95 |
| 2016/0108742 | A1* | 4/2016 | Papple | F01D 5/288 416/95 |
| 2016/0160672 | A1* | 6/2016 | Takata | F01D 1/20 60/605.1 |
| 2017/0022817 | A1* | 1/2017 | Alpan | F01D 5/082 |
| 2017/0122108 | A1* | 5/2017 | Benichou | F01D 5/02 |
| 2017/0130588 | A1* | 5/2017 | Townes | F01D 5/187 |
| 2017/0138211 | A1* | 5/2017 | Fukui | F01D 11/24 |
| 2017/0145827 | A1* | 5/2017 | Lewis | F01D 5/145 |
| 2017/0370231 | A1* | 12/2017 | Lee | F01D 5/186 |
| 2018/0038232 | A1* | 2/2018 | Lee | F01D 5/187 |
| 2018/0328188 | A1* | 11/2018 | Marinelli | F01D 5/188 |
| 2018/0355727 | A1* | 12/2018 | Walunj | F01D 5/18 |
| 2019/0003317 | A1* | 1/2019 | Brittingham | F01D 5/187 |
| 2019/0093500 | A1* | 3/2019 | Song | F16J 15/445 |

* cited by examiner

[FIG. 1]
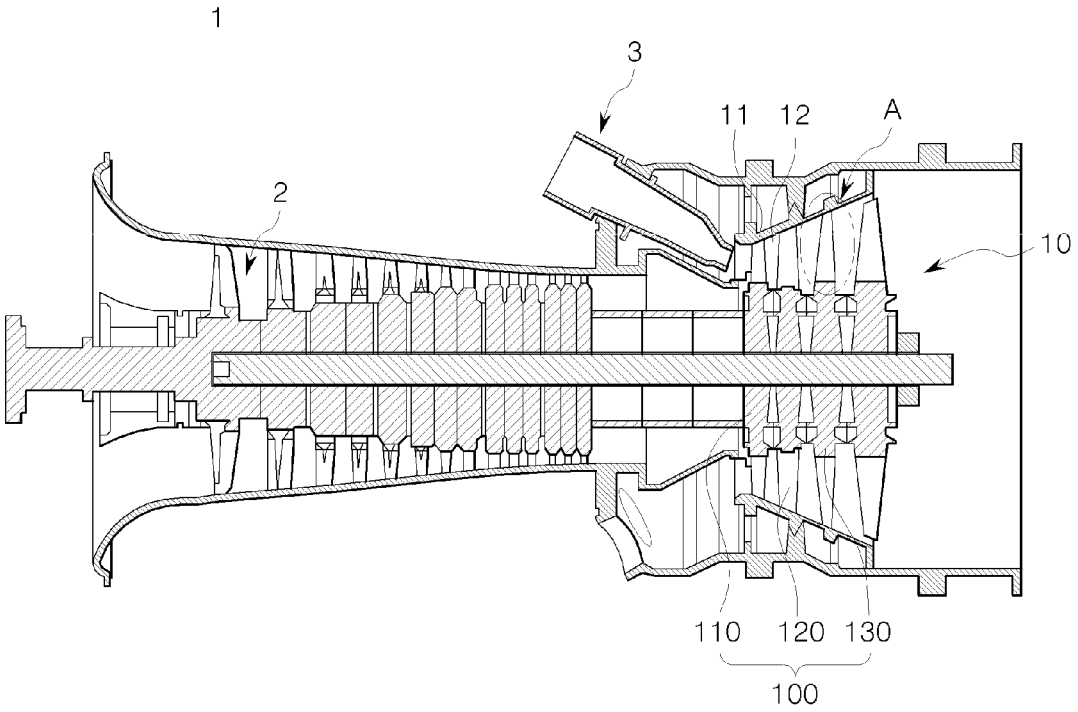

[FIG. 2]
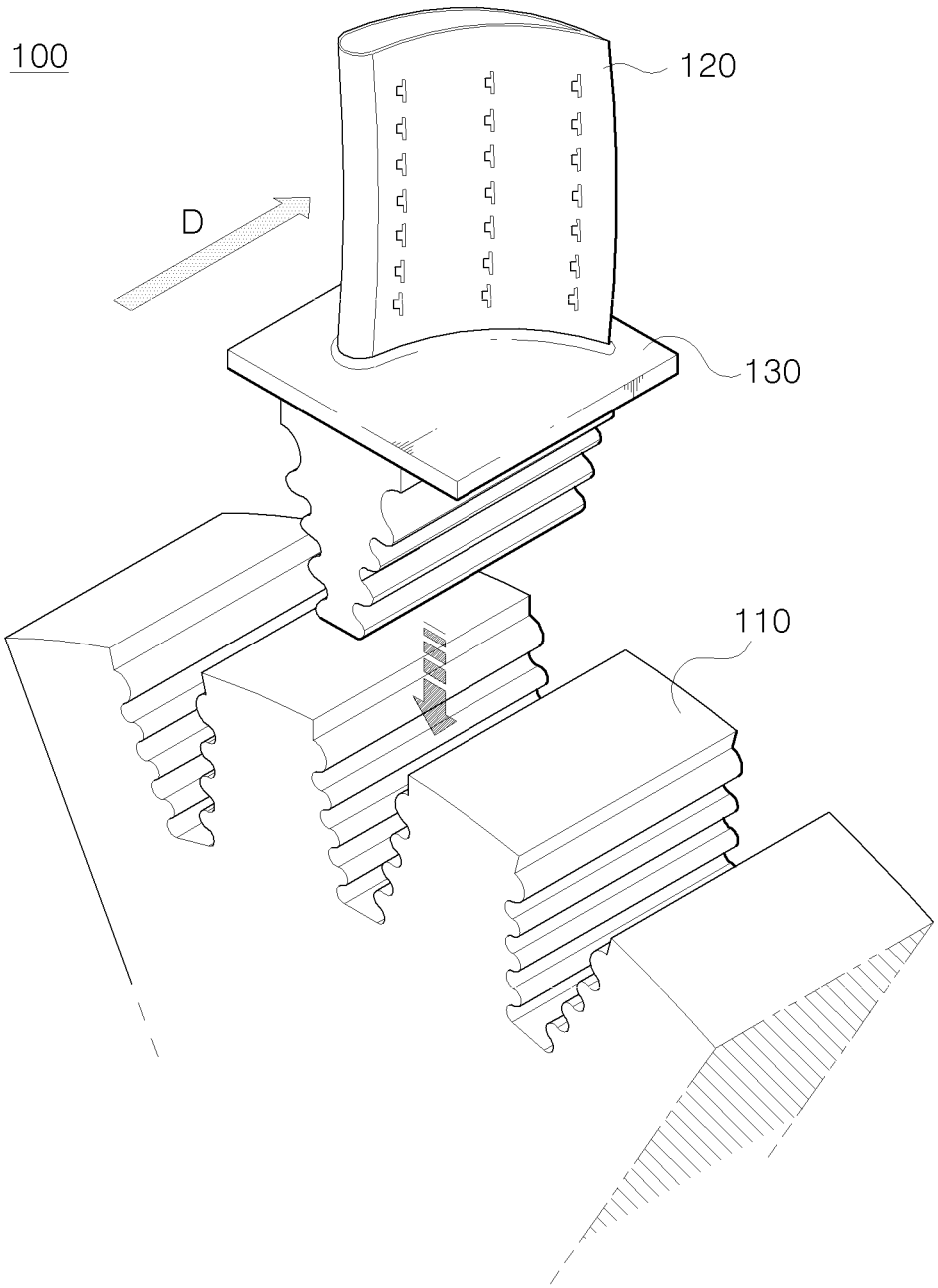

[FIG. 3]
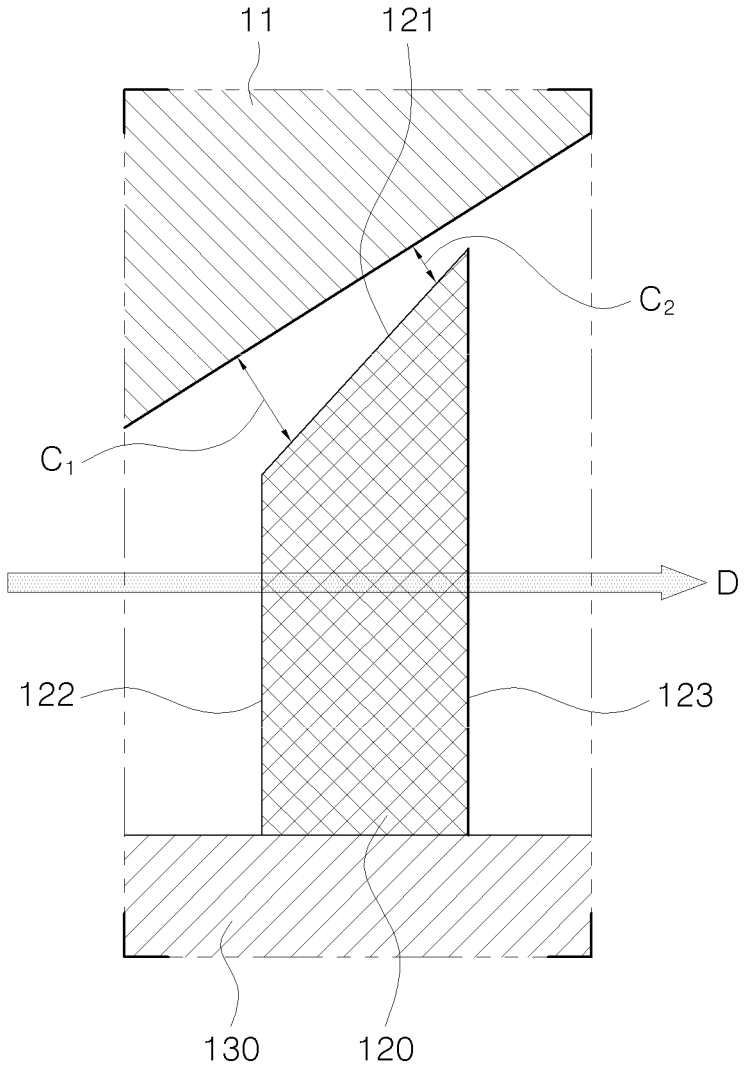

[FIG. 4]
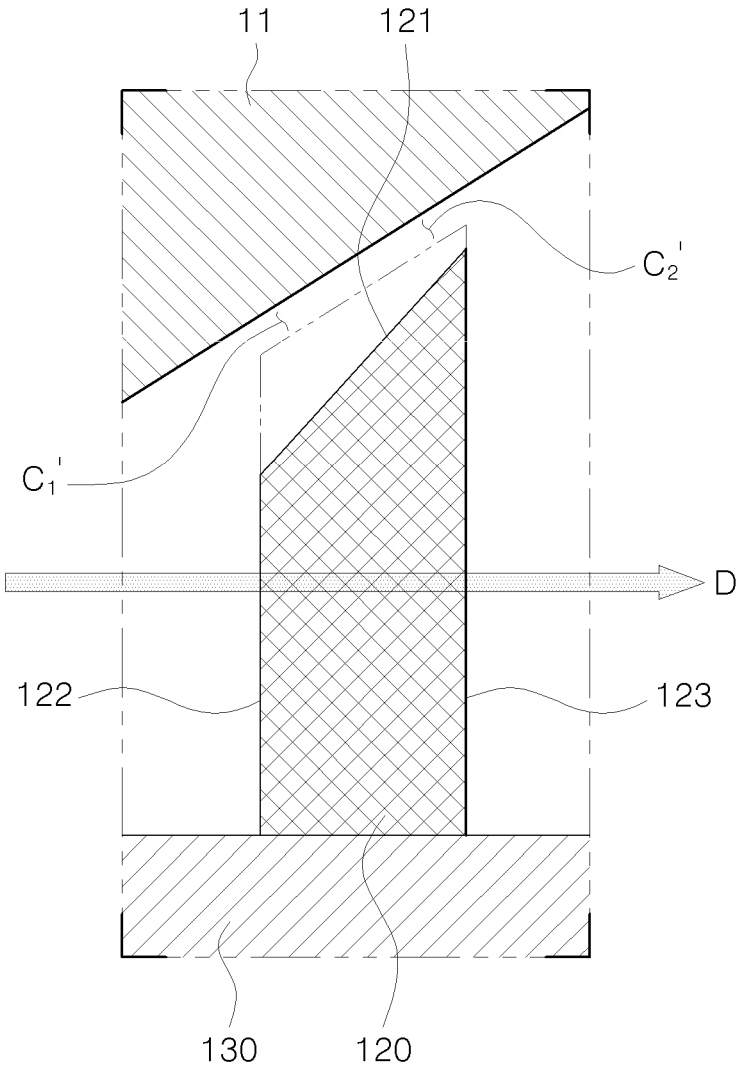

[FIG. 5]
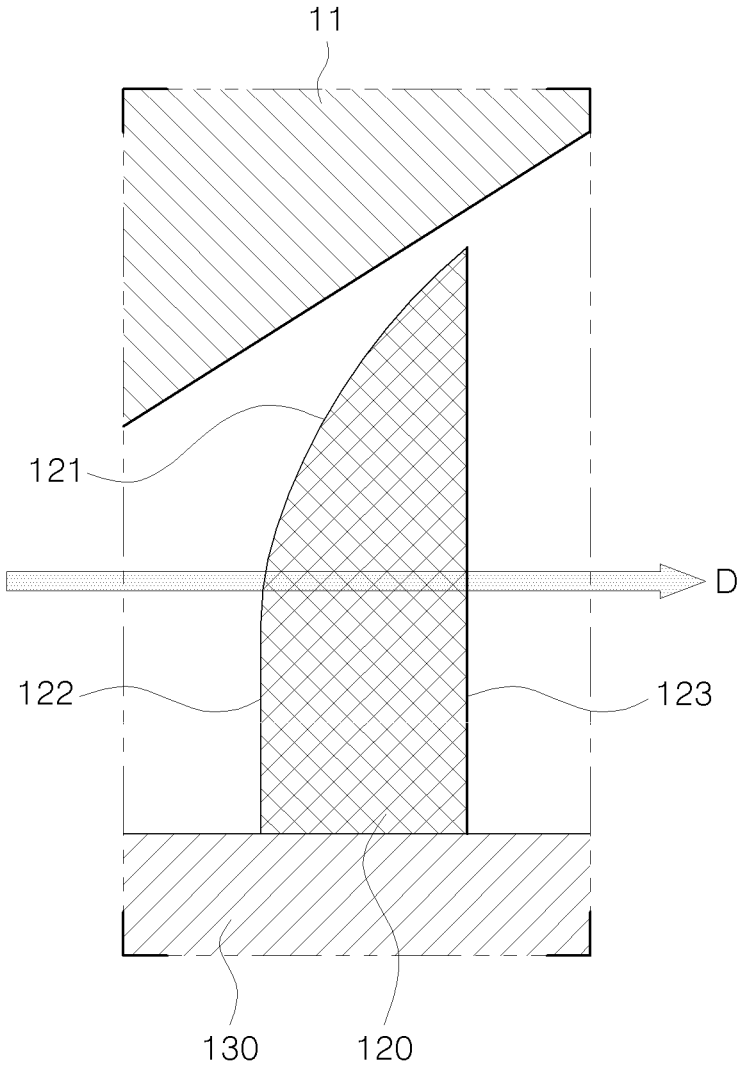

[FIG. 6]
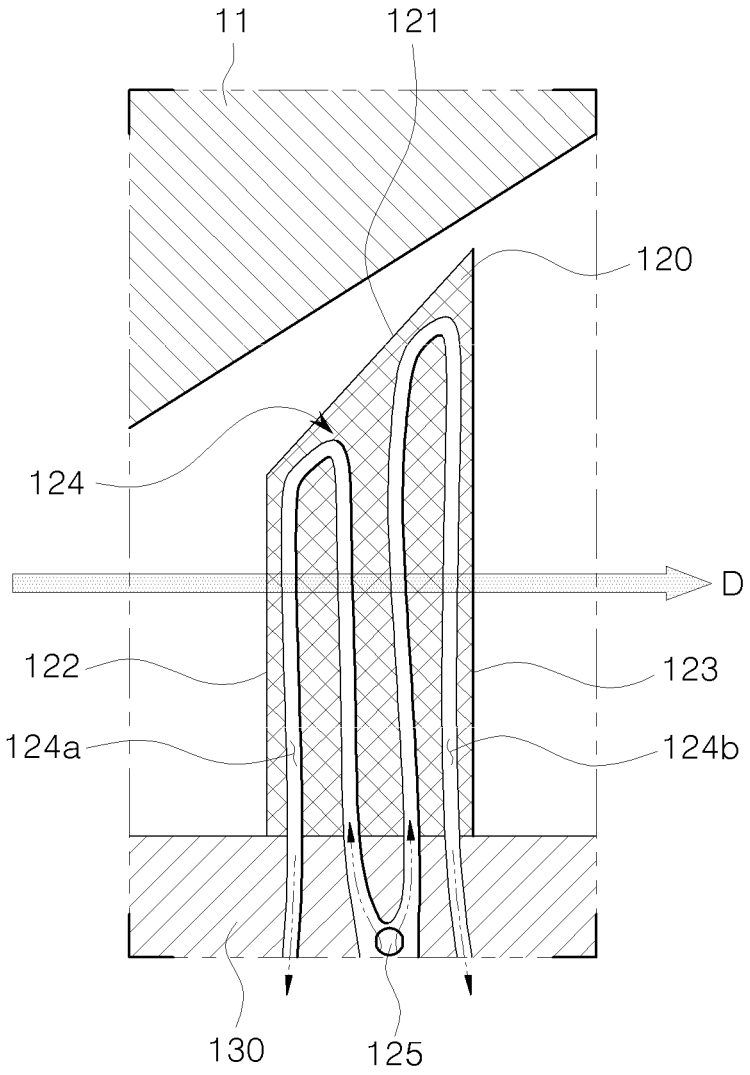

[FIG. 7]
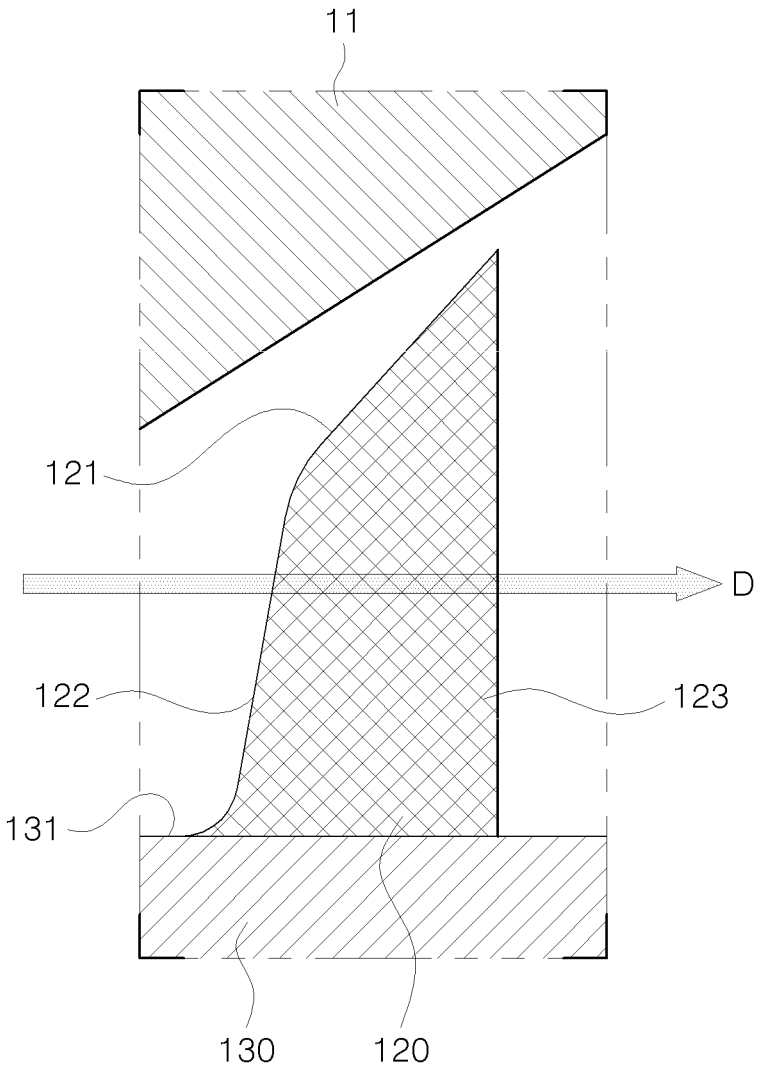

ROTOR HAVING IMPROVED STRUCTURE, AND TURBINE AND GAS TURBINE INCLUDING THE SAME

CROSS-REFERENCE TO RELATED APPLICATIONS

This application claims the benefit of Korean Patent Application No. 10-2017-0127458, filed on Sep. 29, 2017, in the Korean Intellectual Property Office, the disclosure of which is incorporated herein in its entirety by reference.

BACKGROUND OF THE INVENTION

Field of the Invention

Exemplary embodiments of the present disclosure relate to a rotor, a turbine and a gas turbine comprising the same, and more particularly, to a rotor that rotates by combustion gas supplied from a combustor of a gas turbine, a turbine that generates power for electric power generation by rotation of the rotor, and the gas turbine comprising the same.

Description of the Related Art

The gas turbine is mainly composed of a compressor, a combustor, and a turbine. The compressor is provided with a compressor inlet scroll strut for introducing air, and a plurality of compressor vanes and compressor blades are alternately arranged in a compressor casing. The combustor supplies fuel to compressed air that is compressed in the compressor and ignites the air with a burner, which results in generation of combustion gas of high temperature and high pressure.

The turbine has a plurality of turbine vanes and turbine blades, which are alternately arranged in a turbine casing. In addition, a tie rod is disposed so as to pass through the centers of the compressor, the combustor and the turbine, and an exhaust chamber. Both ends of the tie rod are rotatably supported by bearings. A plurality of disks are fixed to the tie rod, each disk having a plurality of blades, and the end of the tie rod closer to the exhaust chamber is connected to a drive shaft of a generator or the like.

The gas turbine has no reciprocating mechanism such as a piston of a four-stroke engine. Therefore, mutual friction parts like piston-cylinder do not exist, which leads to some advantages such as extremely low consumption of lubricating oil, drastic reduction in amplitude (which is characteristic of the reciprocating machine), and high speed motion.

Operations of the gas turbine will be briefly described. Air that has been compressed in the compressor is mixed with fuel and burned to produce a high temperature combustion gas. The produced combustion gas is injected toward the turbine. The injected combustion gas passes through the turbine vane and the turbine blade to generate a rotational force which, in turn, causes the rotor to rotate.

The gas turbine is designed such that an end surface of a turbine blade airfoil and an inner circumferential surface of the turbine casing are parallel to each other. Here, the blade airfoil is divided into an upstream portion that is brought into direct contact with the combustion gas flowing through the turbine and a downstream portion where the combustion gas passing through the blade airfoil exits, and the upstream portion that is brought into direct contact with the combustion gas undergoes a larger thermal expansion than the downstream portion.

For this reason, in the gas turbine, a problem may occur that, as the operating time becomes longer, a tip clearance formed between the turbine blade airfoil and the casing is not kept constant in a flow direction of the combustion gas, with respect to the same stage.

SUMMARY OF THE INVENTION

An object of the present disclosure is to provide a rotor having an improved structure so as to keep a tip clearance constant during operation of the gas turbine. It is a further object of the present disclosure to provide a turbine and a gas turbine including the rotor having the improved structure.

Other objects and advantages of the present disclosure can be understood by the following description, and become apparent with reference to the embodiments of the present disclosure. Also, it is obvious to those skilled in the art to which the present disclosure pertains that the objects and advantages of the present disclosure can be realized by the means as claimed and combinations thereof.

In accordance with one aspect of the present disclosure, there is provided a rotor that is installable in a casing of a turbine and configured to be rotated by a flow of combustion gas and cooled by a flow of compressed air. The rotor may include a disk having an outer circumferential surface; a platform installed on the outer circumferential surface of the disk; and a blade airfoil formed on an upper surface of the platform, the blade airfoil having an airfoil end situated opposite to the platform, the airfoil end having an upstream side and a downstream side with respect to a flow direction of the combustion gas, wherein the blade airfoil is formed so that, when the rotor is installed in the casing, the downstream side of the airfoil end is closer to an inner surface of the casing than the upstream side of the airfoil end.

In accordance with another aspect of the present disclosure, there is provided a turbine through which flows a combustion gas supplied from a combustor and which is cooled by compressed air supplied from a compressor. The turbine may include a stator that includes a casing and a vane installed on an inner surface of the casing; and the above rotor.

In accordance with another aspect of the present disclosure, a gas turbine may include a compressor that sucks and compresses air; a combustor that produces a combustion gas by burning fuel and the compressed air; and the above turbine.

The airfoil end of the blade airfoil may include a convex surface extending from the upstream side of the airfoil end to the downstream side of the airfoil end.

The rotor may further include a cooling passage formed in the blade airfoil through which the compressed air flows, the cooling passage including at least one of an upstream cooling passage passing adjacent to the upstream side of the airfoil end of the blade airfoil, and a downstream cooling passage passing adjacent to the downstream side of the airfoil end of the blade airfoil. A three-way valve may be installed at an inlet of the cooling passage to regulate an amount of the compressed air supplied to the upstream cooling passage and the downstream cooling passage.

The rotor may further include an upstream cooling passage arranged toward an upstream surface of the blade airfoil with respect to the flow direction of the combustion gas, and a downstream cooling passage arranged toward a downstream surface of the blade airfoil with respect to the flow direction of the combustion gas, wherein the upstream and downstream cooling passages are configured to respectively transmit the compressed air from the disk to the blade airfoil in order to effect a relative cooling differential between the upstream and downstream sides of the airfoil end.

The upstream and downstream cooling passages may share a common inlet formed in the disk and are arranged in parallel between the common inlet and respective outlets formed in the disk. A three-way valve may be installed at the common inlet to selectively direct respective amounts of compressed air to the upstream and downstream cooling passages. The three-way valve may be configured to be controlled according to a difference in thermal expansions of the upstream and downstream sides of the airfoil end of the blade airfoil.

The blade airfoil may include an upstream surface facing the flow of the combustion gas and being connected to a clearance surface of the airfoil end of the blade airfoil by a convex surface having a predetermined curvature. The blade airfoil may include an upstream surface facing the flow of the combustion gas and including an incline forming an acute angle with respect to a seating surface of the platform on which the blade airfoil is seated. The blade airfoil may include an upstream surface facing the flow of the combustion gas, and a fillet connecting the upstream surface to the seating surface and having a predetermined curvature extending between the upstream surface and an upstream point of the seating surface.

The airfoil end of the blade airfoil may include a clearance surface that follows a path, relative to the upstream and downstream sides the airfoil end, based on a rate of reduction in tip clearance effected by a thermal expansion of the blade airfoil.

As described above, the rotor, the turbine, and the gas turbine comprising the same according to the present disclosure can be designed such that, with respect to the same stage, the tip clearance of the turbine is reduced in the flow direction of the combustion gas. Therefore, the tip clearance of the turbine can be kept constant during operation of the gas turbine.

BRIEF DESCRIPTION OF THE DRAWINGS

The above and other objects, features and other advantages of the present disclosure will be more clearly understood from the following detailed description taken in conjunction with the accompanying drawings, in which:

FIG. 1 is a sectional diagram showing a schematic structure of a gas turbine to which an embodiment of the present disclosure is applied;

FIG. 2 is an exploded perspective view of a rotor of the turbine shown in FIG. 1;

FIG. 3 is an enlarged view of the portion A of FIG. 1 according to the present disclosure;

FIG. 4 is an alternative view of FIG. 3, showing a thermal deformation of the airfoil end of the blade airfoil;

FIG. 5 is an enlarged view of the portion A of FIG. 1 according to another embodiment of the present disclosure in which the airfoil end is curved;

FIG. 6 is an enlarged view of the portion A of FIG. 1 according to another embodiment of the present disclosure in which a cooling passage is formed in the blade airfoil of FIG. 3; and FIG. 7 is an enlarged view of the portion A in FIG. 1 according to another embodiment of the present disclosure in which the upstream surface of the blade airfoil of FIG. 3 is modified.

DESCRIPTION OF SPECIFIC EMBODIMENTS

While the present disclosure will be described with reference to embodiments shown in the drawings, these are merely illustrative, and it is to be understood by those skilled in the art that various modifications and equivalent embodiments can be made. Therefore, the true scope of protection of the present disclosure should be determined by the technical spirit of the appended claims.

Hereinafter, embodiments of a rotor, a turbine, and a gas turbine comprising the same according to the present disclosure will be described with reference to the drawings.

Referring to FIG. 1, an example of the gas turbine 1 according to the present disclosure is shown. The gas turbine 1 includes a casing and a turbine diffuser is disposed behind the casing to discharge combustion gas passing through the turbine 10. In front of the turbine diffuser, a combustor 3 is disposed to receive compressed air and burn the air.

For description, with respect to a flow direction of air, a compressor 2 is positioned upstream of the casing, and the turbine 10 is disposed downstream of the casing. In this case, the casing includes a compressor casing and a turbine casing 11. The compressor casing receives a compressor vane and a compressor rotor, and the turbine casing 11 receives a turbine vane 12 and a turbine rotor 100. A torque tube is disposes between the compressor 2 and the turbine 10 and serves as a torque transmitting member for transmitting rotational torque generated from the turbine 10 to the compressor 2.

The compressor rotor includes compressor disks and compressor blades. A plurality of compressor disks (for example, fourteen compressor disks) are provided in the compressor casing, and each of the compressor disks is fastened by a tie rod so as not to be axially spaced apart.

Specifically, the compressor disks are each arranged in an axial direction with the tie rod approximately passing through the centers of the compressor disks. Here, each of the compressor disks is disposed such that facing surfaces of the compressor disk and an adjacent compressor disk are pressed to each other by the tie rod so as not to enable relative rotation between compressor disks adjacent to each other.

A plurality of compressor blades are radially coupled to the outer circumferential surface of the compressor disk. A plurality of compressor vanes are each disposed between the compressor disks and are fixed to the housing. The compressor vane is fixed so as not to rotate, unlike the compressor disk, and serves to redirect the flow of compressed air that passes through the compressor blades and guide the compressed air to the compressor blade positioned downstream.

The tie rod is disposed to pass through the centers of the plurality of compressor disks and turbine disks, and one end of the tie rod is fastened to the upper-most compressor disk and the other end thereof is fastened by a fixing nut.

The tie rod may have various shapes depending on the gas turbine 1, and thus it is not necessarily limited to the shape shown in FIG. 1. That is, as shown in the figure, a shape in which one tie rod passes through the centers of the compressor disk and the turbine disk 110 may be taken, a shape in which a plurality of tie rods are arranged in a circumferential direction may be taken, or the two shapes may be used in combination.

Although not shown, the compressor 2 of the gas turbine may be provided with a deswirler serving as a guide pin at the next position of the diffuser to adjust a flow angle of a fluid entering an inlet of the combustor 3 to a designed flow angle after increasing pressure of the fluid.

In the combustor 3, the introduced compressed air is mixed with fuel and the fuel mixed with the air is burned to produce high-temperature and high-pressure combustion gas with high energy, and in the burning process, the combustion gas temperature is raised up to the heat resistance limit that the combustor and turbine parts can withstand.

A plurality of combustors 3 constituting a combustion system of the gas turbine 1 may be arranged in a combustor casing formed in a cell shape, and configured to include a burner (not shown) including a nozzle injecting fuel, a liner forming a combustion chamber, and a transition piece serving as a connection portion between the combustor and the turbine.

Specifically, the liner provides a combustion space in which the fuel injected by the nozzle is mixed with the compressed air of the compressor and the fuel mixed with the air is burned. The liner may include a flame barrel that provides a combustion space in which the fuel mixed with air is burned, and a flow sleeve that forms an annular space while surrounding the flame barrel. The fuel nozzle is coupled to the front end of the liner, and an ignition plug is coupled to a side wall of the liner.

On the other hand, the transition piece is connected to the rear end of the liner so that the combustion gas burned by the ignition plug can be transmitted to the turbine 10. The outer wall portion of the transition piece is cooled by the compressed air supplied from the compressor so as to prevent breakage due to high temperature of the combustion gas.

To this end, the transition piece is provided with holes for cooling so as to inject air inside. The compressed air passing through the holes cools the inner main body and then flows to the liner.

The compressed air that cools the transition piece described above flows into the annular space of the liner, and the compressed air supplied from the outside of the flow sleeve through cooling holes provided in the flow sleeve may collide with the outer wall of the liner.

Meanwhile, the high-temperature and high-pressure combustion gas from the combustor is supplied to the turbine. The supplied high-temperature and high-pressure combustion gas expands and collides with rotating blades of the turbine to produce the reaction force, which in turn generates rotational torque. The rotational torque obtained described above is transmitted to the compressor 2 through the torque tube, and power exceeding the power required for driving the compressor 2 is used to drive the generator and the like.

The turbine 10 is basically similar in structure to the compressor 2. That is, the turbine 10 also includes a plurality of turbine rotors 100 similar to the compressor rotor of the compressor 2. Therefore, the turbine rotor 100 also includes a turbine disk 110 and a plurality of blade airfoils 120 that are radially disposed on the turbine disk 110. A plurality of turbine vanes 12 fixed to the housing are also provided between the blade airfoils 120 so that the turbine vanes 12 guide the flow direction of the combustion gas passing through the blade airfoils 120.

Referring to FIG. 2, the turbine disk 110 is substantially disk shaped and an outer circumferential surface in which a plurality of slots are formed. The turbine rotor 100 has a plate-shaped platform 130. Each side of the platform 130 is in contact with an adjacent platform to maintain the spacing between the blade airfoils 120.

On the bottom surface of the platform 130, a root member that is fastened to the slot is formed. The root member may be formed to correspond to the shape of the curved surface formed in the slot, which may be selected according to the structure required for the commercial gas turbine 1 and may have a dovetail or fir-tree type, which is commonly generally known.

The root member may be fastened by a tangential type method, in which the root member is inserted into the slot in a tangential direction of the outer circumferential surface of the turbine disk, or as shown in FIG. 2, by an axial type method, in which the root member is inserted into the slot in an axial direction of the turbine disk 110. In some cases, the blade airfoil 120 may be fastened to the turbine disk 110 using fasteners of a type other than types described above, such as a key or a bolt.

The blade airfoil 120 is formed on an upper surface of the platform 130. The blade airfoil 120 is formed so as to have an airfoil optimized according to the specifications of the gas turbine 1 and has a leading edge disposed upstream and a trailing edge disposed downstream with respect to the flow direction of the combustion gas.

Here, unlike the compressor blades, the blade airfoil 120 is brought into direct contact with the combustion gas of high temperature and high pressure. Since the temperature of the combustion gas is as high as 1700° C., a cooling means is required. To this end, a bleeding passage (not shown) may be provided so as to bleed off compressed air from certain locations of the compressor and supply the bled-off air to the blade airfoil 120.

The bleeding passage may extend outside the housing (external passage) or through the interior of the compressor disk (internal passage), or both external and internal passages may be used. As shown in FIG. 2, a plurality of film cooling holes are formed on the surface of the blade airfoil 120. The film cooling holes communicate with a cooling passage (not shown) formed inside the blade airfoil 120 to supply compressed air to the surface of the blade airfoil 120.

Referring to FIG. 3, the blade airfoil 120 includes an airfoil end 121 situated opposite to the platform 130, and the airfoil end 121 includes an upstream side and a downstream side with respect to a flow direction D of the combustion gas from the combustors 3. In the blade airfoil 120, the tip clearance present between the airfoil end 121 and an inner surface of the casing 11 is characterized in that, when the rotor 100 is installed in the casing 11, the downstream side of the airfoil end 121 is closer to the inner surface of the casing 11 than the upstream side of the airfoil end 121. This configuration effectively produces a reduction, preferably gradual, in the tip clearance from the upstream side to the downstream side along the flow direction D. That is, the turbine 10 is designed to have different upstream and downstream tip clearances of the airfoil end 121 of the blade airfoil 120. In particular, the turbine 10 is designed such that the upstream tip clearance $C_1$ is larger than the downstream tip clearance $C_2$. As shown in FIG. 3, the surface (hereinafter referred to as the clearance surface) of the airfoil end 121 of the blade airfoil 120 may be formed so as to have an incline which follows an upward path from the upstream side to the downstream side the airfoil end 121, along the flow direction D, such that the tip clearance gradually becomes smaller toward the downstream side. In the drawings, relative distances may be exaggerated to facilitate understanding.

The blade airfoil 120 includes a surface 122 (hereinafter referred to as the upstream surface), which is upstream with respect to the flow of the combustion gas and is thus brought into direct contact with the combustion gas, and a surface 123 (hereinafter referred to as the downstream surface), which is downstream with respect to the flow of the combustion gas and is thus situated where the combustion gas exits. The upstream surface 122 therefore receives heat of higher energy than does the downstream surface 123 and, in turn, undergoes a greater degree of thermal expansion than does the downstream surface 123. Accordingly, the thermal expansion, which is effected on both the upstream and downstream surfaces 122 and 123 of the blade airfoil 120, is unequal. That is, while the thermal expansion reduces both the upstream and downstream tip clearances $C_1$ and $C_2$, the reduction rate of the upstream tip clearance $C_1$ is larger than the reduction rate of the downstream tip clearance $C_2$.

According to an embodiment of the present disclosure, the clearance surface of the airfoil end 121 of the blade airfoil 120 may follow a path, relative to the upstream and downstream sides the airfoil end 121, based on a rate of reduction in tip clearance effected by a thermal expansion of the blade airfoil 120 for each stage. That is, for a thermal expansion attained after a predetermined time of gas turbine operation, the manufactured blade airfoil 120, and specifically the clearance surface of the airfoil end 121 of the blade airfoil 120, preferably compensates for the reduction in tip clearance effected for any given point along the clearance surface of the airfoil end 121. Here, an incline of the clearance surface may reflect a difference between the thermal expansion coefficient of the upstream side of the airfoil end 121 and that of the downstream side.

To demonstrate an effect of the present disclosure, an alternative blade airfoil design can be considered. Here, if the clearance surface of the airfoil end 121 of the blade airfoil 120 were designed to be (initially) parallel to the inner surface of the casing 11, then, as the operating time of the gas turbine 1 elapsed, the upstream side of the airfoil end 121 of the blade airfoil 120 would get closer to the inner surface of the casing 11 than the downstream side of the airfoil end 121. Such design would result in the tip clearance increasing along the flow direction D of the combustion gas and in a turbine 10 exhibiting inconsistent tip clearance for a given stage. Consequently, the blade airfoil 120 would be unable to generate maximum rotational torque by the combustion gas flowing through the blade airfoil 120, which would lead to lowering the driving efficiency of the entire gas turbine 1.

On the other hand, as in the embodiment of the present disclosure, when the turbine 10 is designed such that the downstream side of the airfoil end 121 of the blade airfoil 120 is (initially) closer to the inner surface of the casing 11 than the upstream side of the airfoil end 121, as the operating time of the gas turbine 1 elapses, the upstream tip clearance $C_1$ is reduced to a greater extent than the downstream tip clearance $C_2$. That is, referring to FIG. 4, the upstream and downstream tip clearances $C_1'$ and $C_2'$ of the airfoil end 121 of the blade airfoil 120 after thermal expansion can be kept relatively equal to each other. As a result, the blade airfoil 120 can generate the maximum rotational torque by the combustion gas passing through the blade airfoil 120, which makes it possible to improve the overall efficiency of the gas turbine 1.

Referring to FIG. 5, the airfoil end 121 of the blade airfoil 120 may include a convex surface having a predetermined curvature extending from the upstream side to the downstream side of the airfoil end 121, that is, in the flow direction D of the combustion gas. In other words, the clearance surface of the airfoil end 121 of the blade airfoil 120 may have a convexly curved configuration, to protrude toward the inner surface of the casing 11. With the blade airfoil 120 being so configured, the entire length of the clearance surface of the airfoil end 121 may be brought into contact with the heat energy of the combustion gas evenly. Accordingly, the rotor 100, the turbine 10, and the gas turbine 1 according to the embodiment of the present disclosure can prevent the occurrence of a phenomenon whereby only a specific site of the airfoil end 121, namely, where the heat of the combustion gas concentrates, unevenly protrude toward the inner surface of the casing 11.

Referring to FIG. 6, a cooling passage 124 may be formed in the blade airfoil 120, and the compressed air introduced from the turbine disk 110 may flow through the cooling passage 124. Here, the cooling passage 124 may include an upstream cooling passage 124*a* and a downstream cooling passage 124*b*. The upstream cooling passage 124*a* is arranged toward the upstream surface 122 of the blade airfoil 120 and extends to pass adjacent to the upstream side of the airfoil end 121 to allow the compressed air to flow to the upstream side of the airfoil end 121. The downstream cooling passage 124*b* is arranged toward the downstream surface 123 of the blade airfoil 120 and extends to pass adjacent to the downstream side of the airfoil end 121 to allow the compressed air to flow to the downstream side of the airfoil end 121. The cooling passage 124 may include one or both of the upstream and downstream cooling passages 124*a* and 124*b*, to effect a relative cooling differential between the upstream and downstream sides of the airfoil end 121.

The cooling passage 124 may be configured to have one inlet and two outlets, such that the upstream and downstream cooling passages 124*a* and 124*b* are arranged in parallel. That is, the upstream and downstream cooling passages 124*a* and 124*b* may be formed to share a common inlet. The rotor 100 may further include a three-way valve 125 that is installed at the common inlet to regulate the amount of the compressed air respectively supplied to the upstream cooling passage 124*a* and the downstream cooling passage 124*b*.

In the operation of the gas turbine 1, the upstream side of the airfoil end 121 may undergo a larger or smaller thermal expansion than desired, or its thermal expansion may otherwise be unexpectedly disproportionate relative to that of the downstream side. In the event of an undesirable or unexpected amount of thermal expansion of the upstream side, or relative expansion with respect to that of the downstream side, the three-way valve 125 regulates the flow of compressed air through the common inlet to one or the other of the upstream and downstream cooling passages 124*a* and 124*b*. That is, if the thermal expansion of the upstream side is too great, an opening degree of the cooling passage 124 may be controlled by a controller (not shown) so as to direct a larger supply of compressed air to the upstream cooling passage 124*a* than to the downstream cooling passage 124*b*, or to otherwise increase the supply of compressed air to the upstream cooling passage 124*a* with respect to the downstream cooling passage 124*b*. Conversely, if there is too little thermal expansion of the upstream side, a control of the three-way valve 125 may direct a larger supply of compressed air to the downstream cooling passage 124*b* than to the upstream cooling passage 124*a*.

The three-way valve 125 may be controlled according to a predetermined value that may be set when designing the blade airfoil 120 to reflect the difference between the thermal expansion coefficients respectively exhibited at the upstream and downstream sides of the airfoil end 121. Accordingly, the upstream tip clearance and the downstream tip clearance of the airfoil end 121 of the blade airfoil 120 after thermal expansion may be relatively constant.

Referring to FIG. 7, the upstream surface 122 and the clearance surface of the airfoil end 121 of the blade airfoil 120 may be integrally formed and may be connected to each other by a convex surface having a predetermined curvature. Furthermore, the upstream surface 122 of the blade airfoil 120 may be formed so as to include an incline forming an acute angle with respect to a seating surface 131 of the platform 130 on which the blade airfoil 120 is seated. The upstream surface 122 and the seating surface 131 of the platform 130 may be connected to each other by a fillet having a predetermined curvature extending between the upstream surface 122 and an upstream point of the seating surface 131. Thus, the combustion gas flowing in the turbine 10 may be smoothly guided toward the airfoil end 121 of the blade airfoil 120 along the upstream surface 122 of the blade airfoil 120, and the upstream side of the airfoil end 121 may smoothly exchange heat with the combustion gas, which makes it possible to keep the tip clearance constant for a given stage of the turbine 10.

Although exemplary embodiments of the present invention have been described hereinabove, those skilled in the art will appreciate that various modifications, additions, and substitutions are possible without departing from the scope of the invention as defined in the accompanying claims.

What is claimed is:

1. A rotor that is installable in a casing of a turbine and configured to be rotated by a flow of combustion gas and cooled by a flow of compressed air, the rotor comprising:

a disk having an outer circumferential surface;

a platform installed on the outer circumferential surface of the disk; and a blade airfoil formed on an upper surface of the platform, the blade airfoil including:

an airfoil end situated opposite to the platform, the airfoil end having an upstream side and a downstream side with respect to a flow direction of the combustion gas, and an upstream surface that faces the flow of the combustion gas and includes an inclined portion forming an acute angle with respect to a seating surface of the platform on which the blade airfoil is seated, the upstream surface configured to guide the combustion gas along the upstream surface to the airfoil end, wherein the blade airfoil is formed so that, when the rotor is installed in the casing, the downstream side of the airfoil end is closer to an inner surface of the casing than the upstream side of the airfoil end.

2. The rotor of claim 1, wherein the airfoil end of the blade airfoil includes a convex surface extending from the upstream side of the airfoil end to the downstream side of the airfoil end.

3. The rotor of claim 1, further comprising:

a cooling passage formed in the blade airfoil through which the compressed air flows, the cooling passage including at least one of an upstream cooling passage passing adjacent to the upstream side of the airfoil end of the blade airfoil, and a downstream cooling passage passing adjacent to the downstream side of the airfoil end of the blade airfoil.

4. The rotor of claim 3, further comprising:

a three-way valve installed at an inlet of the cooling passage to regulate an amount of the compressed air supplied to the upstream cooling passage and the downstream cooling passage.

5. The rotor of claim 1, further comprising:

an upstream cooling passage arranged toward the upstream surface of the blade airfoil with respect to the flow direction of the combustion gas, and a downstream cooling passage arranged toward a downstream surface of the blade airfoil with respect to the flow direction of the combustion gas, wherein the upstream and downstream cooling passages are configured to respectively transmit the compressed air from the disk to the blade airfoil in order to effect a relative cooling differential between the upstream and downstream sides of the airfoil end.

6. The rotor of claim 5, wherein the upstream and downstream cooling passages share a common inlet formed in the disk and are arranged in parallel between the common inlet and respective outlets formed in the disk.

7. The rotor of claim 6, further comprising:

a three-way valve installed at the common inlet to selectively direct respective amounts of compressed air to the upstream and downstream cooling passages.

8. The rotor of claim 7, wherein the three-way valve is configured to be controlled according to a difference in thermal expansions of the upstream and downstream sides of the airfoil end of the blade airfoil.

9. The rotor of claim 1, wherein the upstream surface is connected to a clearance surface of the airfoil end of the blade airfoil by a convex surface having a predetermined curvature.

10. The rotor of claim 1, wherein the blade airfoil further includes:

a fillet connecting the upstream surface to a seating surface of the platform on which the blade airfoil is seated, and having a predetermined curvature extending between the upstream surface and an upstream point of the seating surface.

11. The rotor of claim 1, wherein the airfoil end of the blade airfoil includes a clearance surface that follows a path, relative to the upstream and downstream sides the airfoil end, based on a rate of reduction in tip clearance effected by a thermal expansion of the blade airfoil.

12. A turbine through which flows a combustion gas supplied from a combustor and which is cooled by compressed air supplied from a compressor, the turbine comprising: a stator that includes a casing and a vane installed on an inner surface of the casing; and a rotor installed in the casing and rotated by the flow of combustion gas and cooled by the compressed air, the rotor comprising:

a disk having an outer circumferential surface;

a platform installed on the outer circumferential surface of the disk; and a blade airfoil formed on an upper surface of the platform, the blade airfoil including:

an airfoil end situated opposite to the platform, the airfoil end having an upstream side and a downstream side with respect to a flow direction of the combustion gas, and an upstream surface that faces the flow of the combustion gas and includes an inclined portion forming an acute angle with respect to a seating surface of the platform on which the blade airfoil is seated, the upstream surface configured to guide the combustion gas along the upstream surface to the airfoil end, wherein the blade airfoil is formed so that the downstream side of the airfoil end is closer to an inner surface of the casing than the upstream side of the airfoil end.

13. The turbine of claim 12, wherein the airfoil end of the blade airfoil includes a convex surface extending from the upstream side of the airfoil end to the downstream side of the airfoil end.

14. The turbine of claim 12, further comprising:

a cooling passage formed in the blade airfoil through which the compressed air flows, the cooling passage including at least one of an upstream cooling passage passing adjacent to the upstream side of the airfoil end of the blade airfoil, and a downstream cooling passage passing adjacent to the downstream side of the airfoil end of the blade airfoil.

15. The turbine of claim 12, further comprising:

an upstream cooling passage arranged toward the upstream surface of the blade airfoil with respect to the flow direction of the combustion gas, and a downstream cooling passage arranged toward a downstream surface of the blade airfoil with respect to the flow direction of the combustion gas, wherein the upstream and downstream cooling passages are configured to respectively transmit the compressed air from the disk to the blade airfoil in order to effect a relative cooling differential between the upstream and downstream sides of the airfoil end, and wherein the upstream and downstream cooling passages share a common inlet formed in the disk and are arranged in parallel between the common inlet and respective outlets formed in the disk.

16. The turbine of claim 15, further comprising:

a three-way valve installed at the common inlet to selectively direct respective amounts of compressed air to the upstream and downstream cooling passages, wherein the three-way valve is configured to be controlled according to a difference in thermal expansions of the upstream and downstream sides of the airfoil end of the blade airfoil.

17. The turbine of claim 12, wherein the blade airfoil further includes a fillet connecting the upstream surface to the seating surface and having a predetermined curvature extending between the upstream surface and an upstream point of the seating surface; and wherein the upstream surface is connected to a clearance surface of the airfoil end of the blade airfoil by a convex surface having a predetermined curvature.

18. The turbine of claim 12, wherein the airfoil end of the blade airfoil includes a clearance surface that follows a path, relative to the upstream and downstream sides the airfoil end, based on a rate of reduction in tip clearance effected by a thermal expansion of the blade airfoil.

19. A gas turbine comprising:

a compressor that sucks and compresses air;

a combustor that produces a combustion gas by burning fuel and the compressed air; and a turbine that generates power by passing the combustion gas and includes a stator that includes a casing and a vane installed on an inner surface of the casing, and a rotor installed in the casing and rotated by the combustion gas and cooled by the compressed air, the rotor comprising:

a disk having an outer circumferential surface;

a platform installed on the outer circumferential surface of the disk; and a blade airfoil formed on an upper surface of the platform, the blade airfoil including:

an airfoil end situated opposite to the platform, the airfoil end having an upstream side and a downstream side with respect to a flow direction of the combustion gas, and an upstream surface that faces the flow of the combustion gas and includes an inclined portion forming an acute angle with respect to a seating surface of the platform on which the blade airfoil is seated, the upstream surface configured to guide the combustion gas along the upstream surface to the airfoil end, wherein the blade airfoil is formed so that the downstream side of the airfoil end is closer to an inner surface of the casing than the upstream side of the airfoil end.

* * * * *